US005828340A

United States Patent [19]

Johnson

[11] Patent Number: 5,828,340

[45] Date of Patent: Oct. 27, 1998

[54] WIDEBAND SUB-WAVELENGTH ANTENNA

[76] Inventor: J. Michael Johnson, 2225 Roscomare Rd., Los Angeles, Calif. 90077-2222

[21] Appl. No.: 736,781

[22] Filed: Oct. 25, 1996

[51] Int. Cl.[6] ..... H01Q 1/38

[52] U.S. Cl. ..... 343/700 MS; 343/830; 343/846

[58] Field of Search ..... 343/700 MS, 846, 343/848, 795, 825, 828, 829, 830, 831; H01Q 1/38

[56] References Cited

U.S. PATENT DOCUMENTS 4,063,246 12/1977 Greiser ..... 343/700 MS
4,719,470 1/1988 Munson ..... 343/700 MS

*Primary Examiner*—Hoanganh T. Le
*Attorney, Agent, or Firm*—J. Michael Johnson

[57] ABSTRACT

A wideband antenna has a planar conductive tab, a planar ground plane and transmission line. The conductive tab is sub-wavelength in all dimensions and has a top edge that is wider than its bottom end. The width of the conductive tab tapers from the top edge to the bottom end. The ground plane is parallel with and located below the conductive tab. The wideband antenna of the present invention, called a tab monopole, is planar in form enabling it to be readily manufactured using standard printed circuit board methods and facilitating its integration with packages and radio frequency circuitry used to feed the antenna. Operational bandwidths in excess of 40% were realized by this wideband, sub-wavelength antenna.

10 Claims, 5 Drawing Sheets

WIDEBAND SUB-WAVELENGTH ANTENNA

BACKGROUND OF THE INVENTION

1. Field of the Invention

The present invention relates to wideband, planar antennas. In particular, the present invention is a novel, sub-wavelength, planar monopole antenna that features wideband operation and that can be manufactured using printed circuit methods.

2. Description of the Related Art

The recent, unprecedented growth in the demand for and usage of wireless mobile telephones and the subsequent explosive proliferation of related wireless mobile telecommunication systems has necessarily created a strong interest in compact, sub-wavelength antennas that are easily manufactured and readily integrated into these systems. In parallel with and, in part, resulting from the growth in applications, is a movement from narrow band to wideband systems. A variety of recent advances have begun to focus mobile terminal systems on broadband, spread spectrum and/or multiple frequency, operation leading to the need for much wider bandwidth components for these systems. This, in turn, leads to the need for compact, sub-wavelength mobile terminal antennas which feature wider bandwidth performance than is currently available. Beyond the wireless, mobile terminal application, there is also a need for broad band, readily mass produced, compact antennas for antenna array applications.

The standard, wire monopole is probably the most widely used antenna on existing mobile telecommunication applications with the normal mode helix coming in a close second. The reason for the widespread use of wire monopoles and helices in mobile terminal application is that these antenna are simple and relatively inexpensive to manufacture. Wire monopoles and helices are not, however, particularly easy to integrate into handset or mobile terminal cases. Generally, wire monopoles and helices are manufactured independently of the terminal case, as separate items, that must then be connected to the case and the internal terminal electronics during assembly. The monopoles and helices also protrude from the terminal case subjecting them to damage during use.

Planar antennas, particularly those that can be manufactured using standard printed circuit methods, offer attractive alternatives to the wire monopole and helices for wireless terminal applications. Sub-wavelength, planar antennas known in the art include ¼ wavelength and ½ wavelength patch antennas and the planar inverted F (PIFA) antenna. The ½ wavelength patch antenna is approximately ½ wavelength in length and width while the ¼ wavelength patch is ¼ in length and slightly greater than ½ wavelength in width. The PIFA is also sub-wavelength in size usually about 0.2 wavelength in length and 0.1 wavelength wide. All of these patch antennas are readily manufactured using printed circuit methods and feature good, linear polarized radiation patterns suitable for many mobile terminal applications.

In general, sub-wavelength antennas are narrow band. Wire monopoles and helices have operational bandwidths typically on the order of 5–15%. The patch antennas, both ¼ and ½ wavelength, have operational bandwidths typically less than %10 in most cases. PIFA antennas are also narrow band having bandwidths up to approximately 15%.

As used herein, the band width of an antenna is the ratio of the difference between the upper and lower frequency limits of operation to the center frequency. The operational frequencies are those frequencies for which the antenna provides a return loss of below −10 dB.

Therefore, it would be desirable to have a planar antenna that is sub-wavelength in size with significantly wider band operation than existing planar antennas known in the art, and that can be manufactured using standard printed circuit methods. Such an antenna would overcome a long standing problem in the area of antenna technology.

SUMMARY OF THE INVENTION

In accordance with the present invention, a new sub-wavelength antenna is provided that by virtue of its unique shape exhibits significantly wider bandwidth operation than existing antennas known in the art. The wideband antenna of the present invention, called a tab monopole, is planar in form enabling it to be readily manufactured using standard printed circuit board methods and facilitating its integration with packages and radio frequency circuitry used to feed the antenna.

The tab monopole antenna of the present invention comprises a thin, planar, conductive tab having a top edge and a bottom end, the top edge being wider than the bottom end, and a tapered region connecting the top edge and bottom end. The tab is located above a ground plane that may or may not be co-planar with the tab. The ground plane has an upper edge that is aligned with the bottom end of the tab. The tab is fed by a suitable transmission line connected to the bottom end of the tab at the ground plane upper edge.

In a preferred embodiment of the present invention, the tab monopole is readily manufactured using standard printed circuit board methods, such that the tab and ground plane can be attached to and supported by a dielectric material.

Alternatively, the tab monopole of the present invention can be fabricated without supporting dielectric using other fabrication techniques.

The tab monopole of the present invention has a tab top edge width of nominally 0.2 wavelengths and a height above the ground plane upper edge of nominally 0.1 wavelengths. The preferred embodiment of the tab monopole of the present invention has a tab tapered region of nominally 25 degrees. The tab monopole antenna of the present invention produces a relatively omni-directional azimuth antenna pattern for vertical polarization. The operational bandwidth in terms of a −10 dB input return loss is unexpectedly and advantageously in excess of 40% with measured values of greater than 50% being typical.

BRIEF DESCRIPTION OF THE DRAWINGS

Further details are explained below with the help of the examples illustrated in the attached drawings in which.

DETAILED DESCRIPTION OF THE PREFERRED EMBODIMENTS

Figure 1:
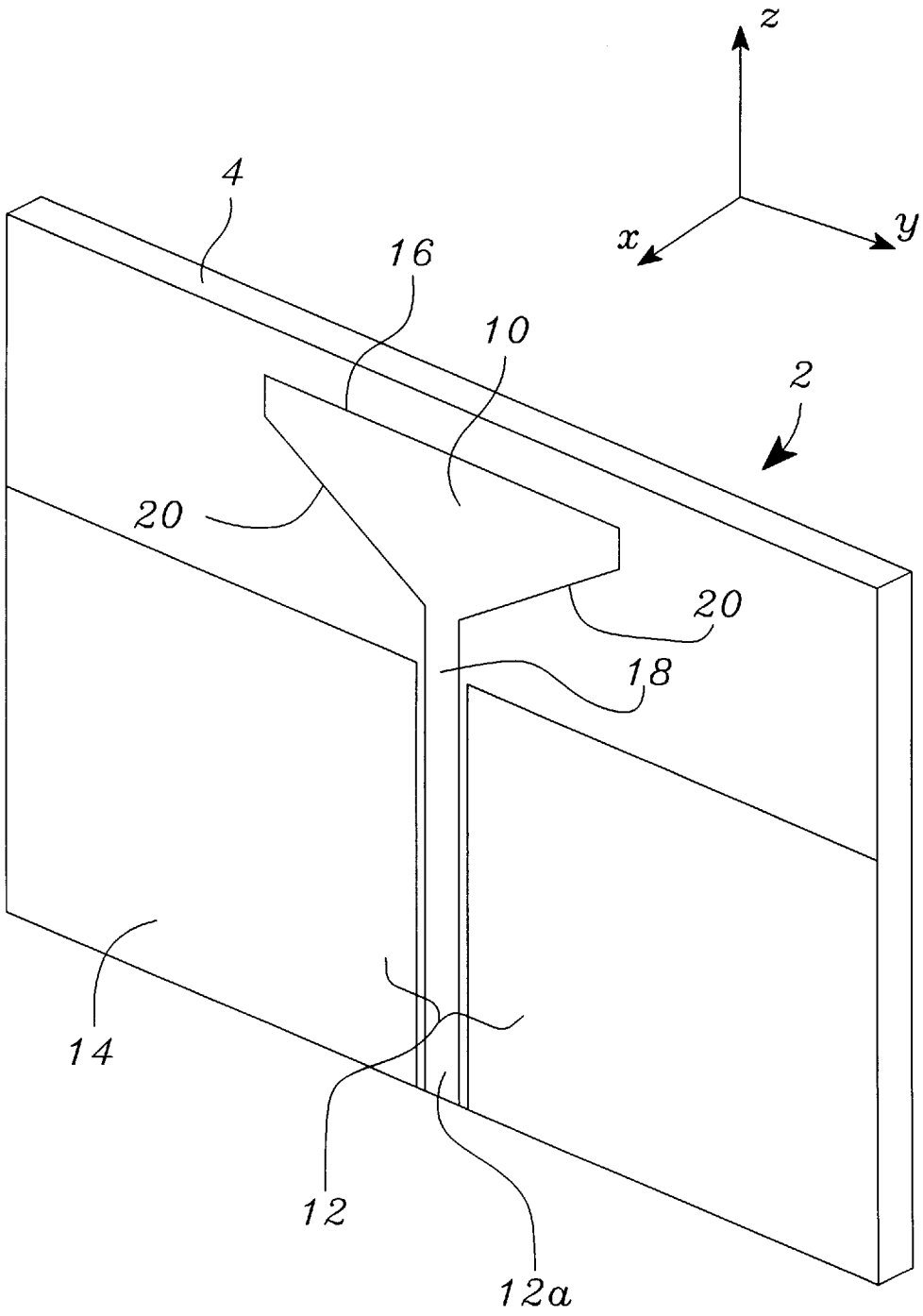
FIG. 1 illustrates a perspective view of one embodiment of the tab monopole of the present invention along with a Cartesian (x-y-z) axis for later reference.
Figure 2:
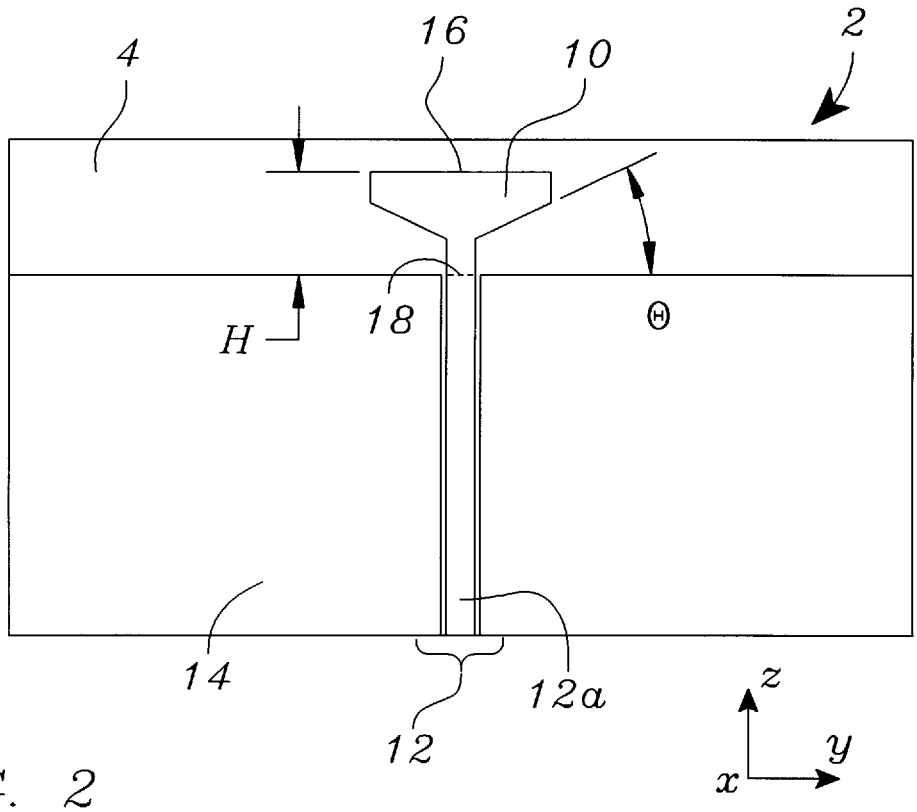
FIG. 2 illustrates a front or plan view of the embodiment of the tab monopole in FIG. 1.
Figure 3:
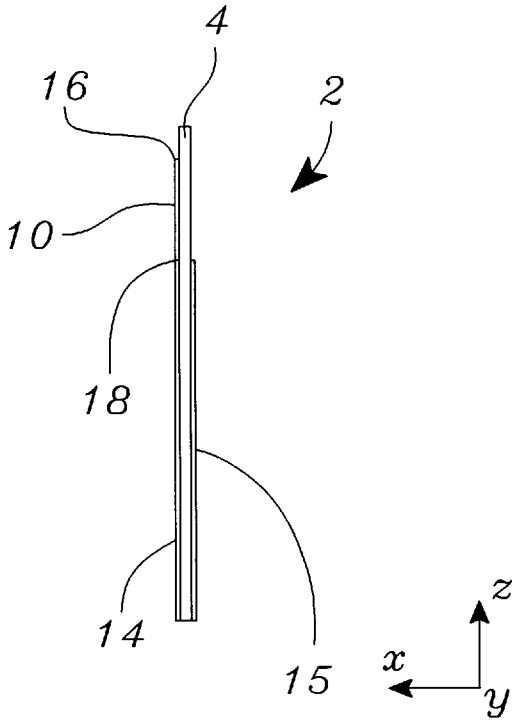
FIG. 3 illustrates a side view of the embodiment of the tab monopole in FIG. 2 further illustrating a backside ground plane.

The tab monopole antenna of the present invention is illustrated in FIG. 1–4. FIGS. 1–3 illustrate a preferred embodiment of the tab monopole 2. The tab monopole 2 is comprised of a sub-wavelength, tapered, radiating element or tab 10, fed by a suitable transmission line 12 and situated above a planar conductive ground plane 14 when the antenna 2 is oriented as illustrated in FIG. 1. The tab 10 is a thin, flat, planar conductive element having a top edge 16 and a bottom end 18, wherein the top edge 16 is wider than bottom end 18. A tapered transition region 20 of the tab 10 is located between the top edge 16 and the bottom end 18. The tab is connected to the feeding transmission line 12 at the bottom end 18 of the tab 10. The tab 10 surface is parallel with the ground plane 14 surface. The tab 10 and the ground plane 14 are constructed from a suitable low loss conductive material or metal, such as but not limited to, copper, gold, silver, brass, or aluminum.

Figure 5:
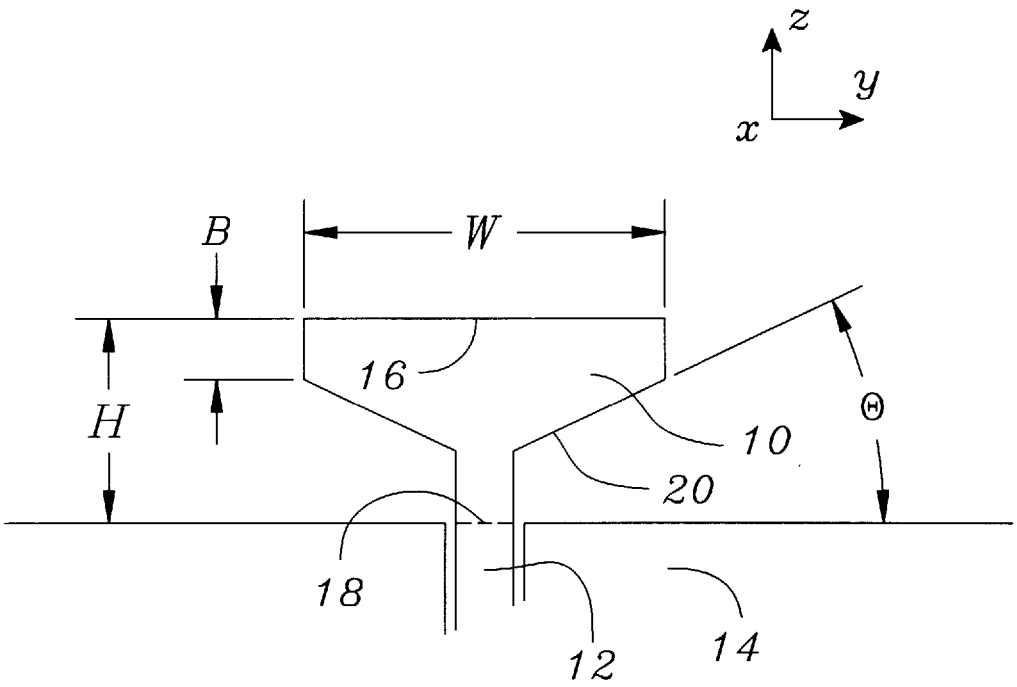
FIG. 5 illustrates details of the tab portion of the tab monopole antenna.

The tab 10 is nominally 0.1 λ high as indicated by H in FIG. 5 measured from the upper edge of ground plane 14 to the top edge 16 of the tab 10. The top edge 16 of the tab 10 is nominally 0.2 λ wide W. Heights H of between 0.02 λ and 0.5λ and widths W of between 0.05λ and 0.9λ can be used for tab 10. The wavelength λ herein refers to the free space wavelength. The tab 10 has a taper angle Θ of between twenty and forty degrees (nominally 25 degrees) that begins B wavelengths below the top edge 16 of the tab 10 where B is nominally 0.04 wavelengths and depends on the taper angle Θ. Tab 10 dimension B can range between 0.01λ and 0.1λ. Exact height, width and taper of the tab 10 can be readily chosen by the skilled artisan without undue experimentation to achieve the best match for a given feeding configuration (i.e. impedance and type of feeding transmission line) and ground plane style (e.g. front side and/or back side).

In the preferred embodiment, the tab monopole 2 may be constructed using standard printed circuit board etching processes wherein conventional photo-lithographic methods are used to define a metal pattern on a metalized dielectric substrate. Several transmission lines types are well suited for printed circuit board application including microstrip, stripline, coplanar waveguide and grounded coplanar waveguide. A coplanar waveguide is illustrated as the feeding transmission line 12 in FIG. 1. A grounded coplanar waveguide is illustrated in FIGS. 2 and 3 as the feeding transmission line 12. When constructed using printed circuit methods and using a coplanar waveguide, the tab 10 and the ground plane 14 are coplanar. In the case of grounded coplanar waveguide, the ground plane 14 is coplanar with the tab 10 and a second conductive ground plane 15 on the back side of the substrate is used as illustrated in FIG. 3. In the case of microstrip, the back side ground plane 15 is used without including the ground plane 14 so that the tab 10 and ground plane 15 are not coplanar but are simply parallel. When a back side ground plane 15 is used, the ground plane 15 upper edge is aligned with the bottom end 18 of the tab 10 as was the case for the ground plane 14. In general, the width of the bottom end 18 of tab 10 is chosen to be the same as the width of the center conductor 12*a* of the feeding transmission line 12 to minimize parasitic interactions at the transmission line 12-to-tab 10 boundary.

Details of the construction of the transmission line 12 are not provided here since one skilled in the art would be acquainted with these details and since they have no significant impact on the particulars of the tab monopole of the present invention. The extent or width of the ground plane 14 is likewise of little practical concern and can range from a wavelength to many wavelength. Additionally, a ground plane in the x-y plane, perpendicular to the z-oriented tab 10 can be used instead of the horizontal y-z plane-oriented ground plane depicted in the FIGS. 1–4.

Figure 4:
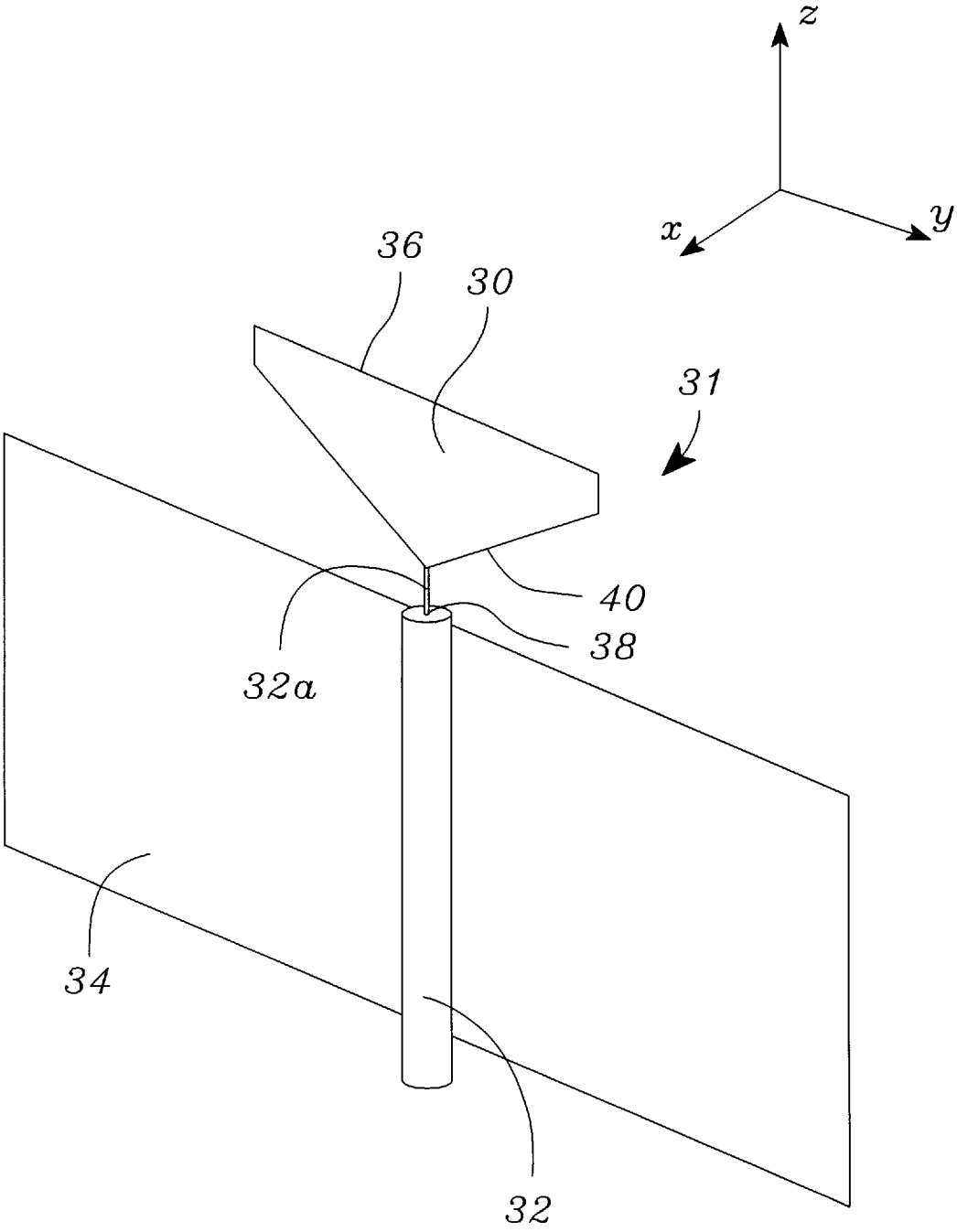
FIG. 4 illustrates a perspective view of another embodiment of the tab monopole without a supporting dielectric substrate.

The tab monopole of the present invention can be manufactured by other than printed circuit methods. FIG. 4 illustrates a tab monopole 31 having a tab 30 that is unsupported by a dielectric substrate. This embodiment can utilize a coax cable as the feeding transmission line 32. The center conductor 32*a* of the coax transmission line 32 can form the bottom end 38 of the tab monopole 31 with a metal sheet forming the tab 30. In such an embodiment, bottom end 38 of tab monopole 31 is the point were the center conductor 32*a* of the coax cable departs from the outer conductor of the coax transmission line 32. In addition, as illustrated in FIG. 4, the ground plane 34 can be constructed from a conductive sheet attached to the outer conductor of the coax transmission line 32.

The tab monopole has a broad relatively omni directional, radiation pattern in azimuth. The azimuth plane in this case is the x-y plane for a z-oriented tab as illustrated in FIGS. 1 and 2. The tab monopole is nominally linearly polarized. The tab monopole is found to advantageously and unexpectedly exhibit a wide bandwidth of operation. Tab monopole antennas of the present invention have operation bandwidths typically greater than 40%. This is in sharp contrast to other sub-wavelength antennas known in the art which typically have bandwidths less than 15%.

A prototype tab monopole 2 was fabricated and tested. The prototype was fabricated using standard double sided printed circuit methods. A 0.0625 inch thick Duroid RT5880 dielectric substrate manufactured by Rogers Corporation of Chandler, Ariz. was used. The substrate material, RT5880, has a dielectric constant of 2.2 and is low loss. The substrate was clad on both sides with 1 ounce copper. The tab 10 and grounded coplanar waveguide transmission line 12 was etched on the front and back side of a 2.75 inch by 5.0 inch substrate. The grounded coplanar waveguide was designed for 50 ohm operation. The tab 10 had a height H of 0.11 λ and a top edge width W of 0.22 λ. The tab bottom end 18 width was chosen to match that of the coplanar waveguide transmission line 12 center conductor 12*a* which was 0.1592 inches. The design center frequency of the prototype was 2.6 GHz yielding a tab 10 top edge 16 width W of 1.00 inch and tab height H of 0.57 inches. The tab 10 taper Θ was 25 degrees and the taper began at B=0.037 wavelengths or 0.17 inches from the tab 10 top edge 16. A plurality of vias were used to provide electrical connection between the ground plane 14 and back ground plane 15 to suppress undesirable propagation modes known to exist in the grounded coplanar waveguide transmission line structure.

Figure 6:
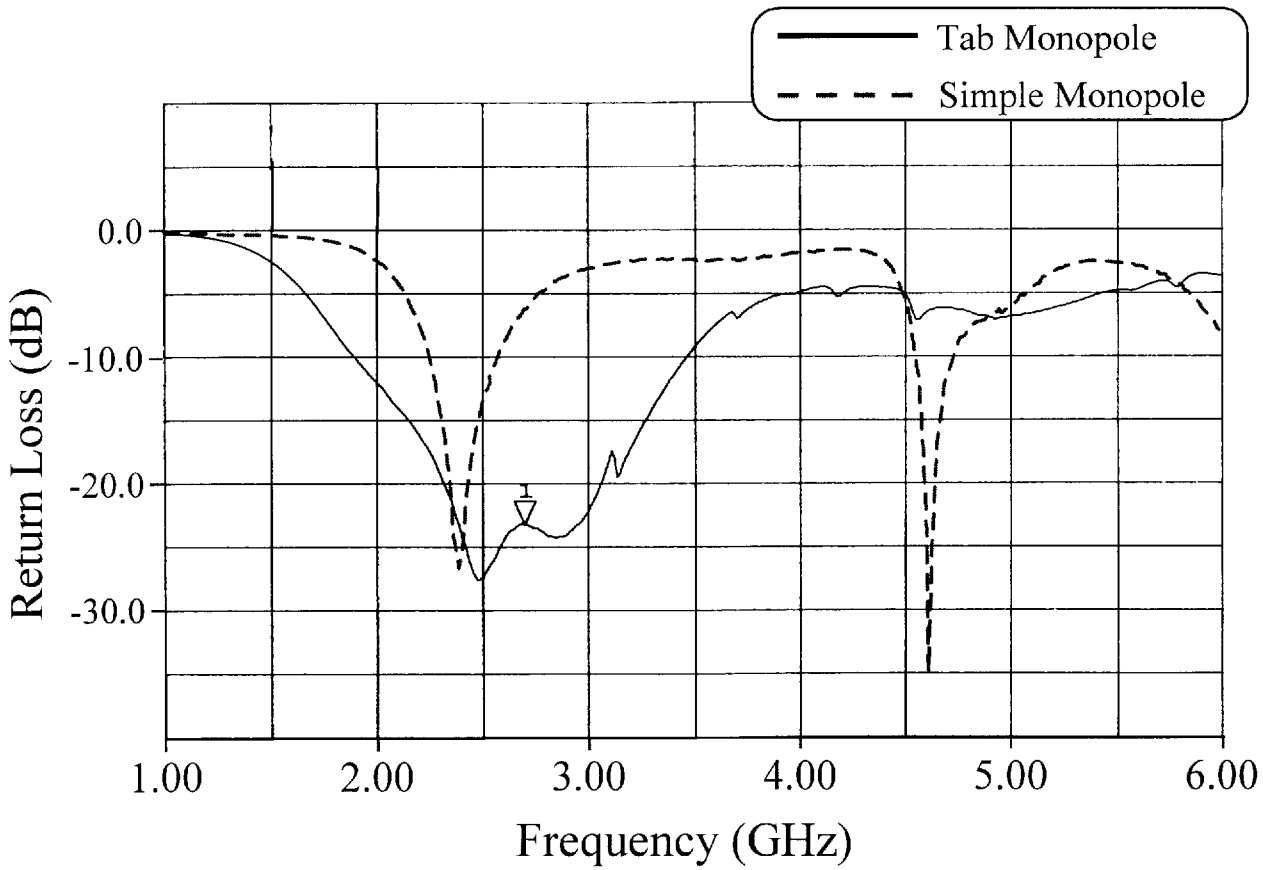
FIG. 6 illustrates by way of comparison the measured return loss performance for a prototype tab monopole of the present invention and that of a traditional wire monopole antenna.

FIG. 6 illustrates the measured magnitude return loss, or $S_{11}$ magnitude, for the 2.6 GHz prototype tab monopole 2 of FIGS. 2 and 3. The measured $S_{11}$ magnitude of a conventional wire monopole is also provided in FIG. 6 for comparison purposes. The $S_{11}$ measurements presented in FIG. 6 were made utilizing an HP 8510B network analyzer with the tab monopole 2 mounted in an anechoic chamber to minimize errors in the measured values. The measured input return loss of the tab monopole 2 of the present invention is less than −10 dB over approximately 1.5 GHz and unexpectedly resulted in an operational bandwidth of greater than 50%. The best S11 return loss was better (or less) than −25 dB. This wideband operation feature of the invention overcomes the problem described above for the related art, and consequently, is advantageous for many potential applications of the tab monopole 2.

Thus there has been disclosed a new, sub-wavelength, planar antenna called a tab monopole that unexpectedly and advantageously features significantly wider bandwidth operation than planar sub-wavelength antennas known in the art and can be manufactured using standard printed circuit methods. Changes and modifications may be made to the invention which may be readily apparent to those skilled in the art without going beyond the intended scope of the invention, as defined by the appended claims.

What is claimed is:

1. A wideband antenna comprising:

a planar conductive tab having a top edge, a tapered region and a bottom end wherein said top edge is wider than said bottom end and said tapered region lies between said top edge and said bottom end;

a planar conductive ground plane that is parallel with said conductive tab and located below said bottom end of said conductive tab, said ground plane having an upper edge that is aligned with said bottom end of said conductive tab; and a transmission line connected to said bottom end of the planar conductive tab, wherein said top edge of said conductive tab is nominally 0.2 wavelengths wide and is located nominally 0.1 wavelengths from said upper edge of said ground plane, and wherein wavelength is a free space wavelength at a center frequency of operation.

2. The wideband antenna as in claim 1, wherein said tapered region has a taper angle of nominally 25 degrees measured from said top edge of said ground plane, and wherein said tapered region begins nominally 0.04 wavelengths below the top edge of the conductive tab.

3. The wideband antenna as in claim 1, wherein said conductive tab, said ground plane and said center conductor of said transmission line are supported by and located on one side of a dielectric substrate.

4. The wideband antenna as in claim 3, wherein said conductive tab, said ground plane and said transmission line are formed on said dielectric substrate by standard printed circuit board fabrication techniques.

5. The wideband antenna of claim 3, further comprising a backside ground plane located on an opposite side of said dielectric substrate, said backside ground plane having an upper edge in alignment with the upper edge of the planar ground plane.

6. The wideband antenna of claim 5, wherein said transmission line is a grounded coplanar waveguide.

7. The wideband antenna of claim 1, wherein said transmission line is a coaxial cable and said bottom end of said conductive tab comprises a center conductor of said coax cable above said upper edge of said ground plane.

8. The wideband antenna of claim 1, wherein said transmission line is a coplanar waveguide.

9. The wideband antenna of claim 1, wherein said conductive tab and said center conductor of said transmission line are supported by and located on one side of a dielectric substrate and said ground plane is located on an opposite side of said dielectric substrate.

10. The wideband antenna of claim 5, wherein said transmission line is a microstrip transmission line.

* * * * *